US010190308B2

(12) United States Patent
De Almeida Borges

(10) Patent No.: US 10,190,308 B2
(45) Date of Patent: Jan. 29, 2019

(54) ROOF TRUSS ASSEMBLY

(71) Applicant: Carlos Alberto De Almeida Borges, Rio de Janeiro (BR)

(72) Inventor: Carlos Alberto De Almeida Borges, Rio de Janeiro (BR)

( * ) Notice: Subject to any disclaimer, the term of this patent is extended or adjusted under 35 U.S.C. 154(b) by 0 days.

(21) Appl. No.: 15/887,568

(22) Filed: Feb. 2, 2018

(65) Prior Publication Data

US 2018/0155918 A1 Jun. 7, 2018

Related U.S. Application Data

(63) Continuation of application No. PCT/BR2017/000062, filed on Jun. 20, 2017.

(30) Foreign Application Priority Data

Jun. 20, 2016 (BR) ..... 1020160145260

(51) Int. Cl.
*E04H 12/00* (2006.01)
*E04B 1/19* (2006.01)
(Continued)

(52) U.S. Cl.
CPC ..... *E04B 1/19* (2013.01); *E04B 1/24* (2013.01); *E04B 7/10* (2013.01); *E04C 2/40* (2013.01);
(Continued)

(58) Field of Classification Search
CPC ..... E04B 1/19; E04B 1/24; E04B 7/10; E04B 2001/2457; E04B 2001/2415;
(Continued)

(56) References Cited

U.S. PATENT DOCUMENTS 2,152,189 A * 3/1939 Henderson ..... E04B 1/24 52/579
2,284,898 A * 6/1942 Hartman ..... E04B 1/19 52/376
(Continued)

FOREIGN PATENT DOCUMENTS

BR 7805402 A 4/1979
BR 8504326 A 4/1987
(Continued)

OTHER PUBLICATIONS

International Search Report for PCT/BR2017/000062, dated Dec. 28, 2017.
(Continued)

*Primary Examiner* — Basil S Katcheves
(74) *Attorney, Agent, or Firm* — Pearne & Gordon LLP

(57) ABSTRACT

The present invention comprises a structure for coverage formed by various structural elements, in particular a main element comprising one piece (stringer), said stringer (1) comprising in its basic embodiment a steel plate approximately 1-2 mm thick, conformed in a characteristic way by a tool in a continuous process, said shape essentially longitudinal, comprising several holes (5, 7) and pairs of fins (9), also known as shields in your extension, arranged modularly in a characteristic fashion in a basic pre-determined pattern, the piece (stringer) (1) being capable of being made in several lengths, being connected to one another by connecting plates (6) of characteristic geometry.

7 Claims, 23 Drawing Sheets

(51) Int. Cl.

| | |
|---|---|
| ***E04B 7/10*** | (2006.01) |
| ***E04C 2/40*** | (2006.01) |
| ***E04C 3/09*** | (2006.01) |
| ***E04C 3/04*** | (2006.01) |
| ***E04B 1/24*** | (2006.01) |

(52) U.S. Cl.
CPC ..... *E04C 3/04* (2013.01); *E04C 3/09* (2013.01); *E04B 2001/1936* (2013.01); *E04B 2001/1963* (2013.01); *E04B 2001/1975* (2013.01); *E04B 2001/1987* (2013.01); *E04B 2001/2415* (2013.01); *E04B 2001/2418* (2013.01); *E04B 2001/2457* (2013.01); *E04C 2003/0413* (2013.01); *E04C 2003/0434* (2013.01); *E04C 2003/0473* (2013.01)

(58) Field of Classification Search
CPC ..... E04B 2001/2418; E04C 3/04; E04C 3/09; E04C 2/40; E04C 2003/0434; E04C 2003/0413; E04C 2003/0473; E04C 2001/1987; E04C 2001/1936; E04C 2001/1963; E04C 2001/1975
USPC ..... 52/653.1
See application file for complete search history.

(56) References Cited

U.S. PATENT DOCUMENTS 3,336,717 A 8/1967 Ward et al.
3,826,057 A * 7/1974 Franklin ..... E04C 3/08 52/641
3,966,164 A * 6/1976 Dashew ..... E04G 11/48 249/18
3,977,536 A * 8/1976 Moore ..... E04G 19/003 249/18
4,569,501 A * 2/1986 McCracken ..... E04G 11/52 249/18
4,585,204 A * 4/1986 Parker ..... E04G 11/40 249/27
4,790,113 A * 12/1988 Gregory ..... E04G 11/38 249/28
4,833,844 A 5/1989 Wiklund
5,251,412 A 10/1993 De Almeida Borges
5,273,415 A * 12/1993 Jackson ..... E04G 19/003 248/163.1
6,928,782 B2 * 8/2005 Becker ..... E04B 5/10 52/693

FOREIGN PATENT DOCUMENTS

| | | | |
|---|---|---|---|
| BR | 9100456 | | 9/1992 |
| BR | 9304495 | A | 7/1995 |
| BR | 9601145 | A | 1/1998 |
| BR | PI0902183 | A2 | 12/2010 |
| GB | 1099480 | A | 1/1968 |
| WO | 8504442 | A1 | 10/1985 |

OTHER PUBLICATIONS

Written Opinion of the International Search Authority for PCT/BR2017/000062, dated Dec. 28, 2017.

* cited by examiner

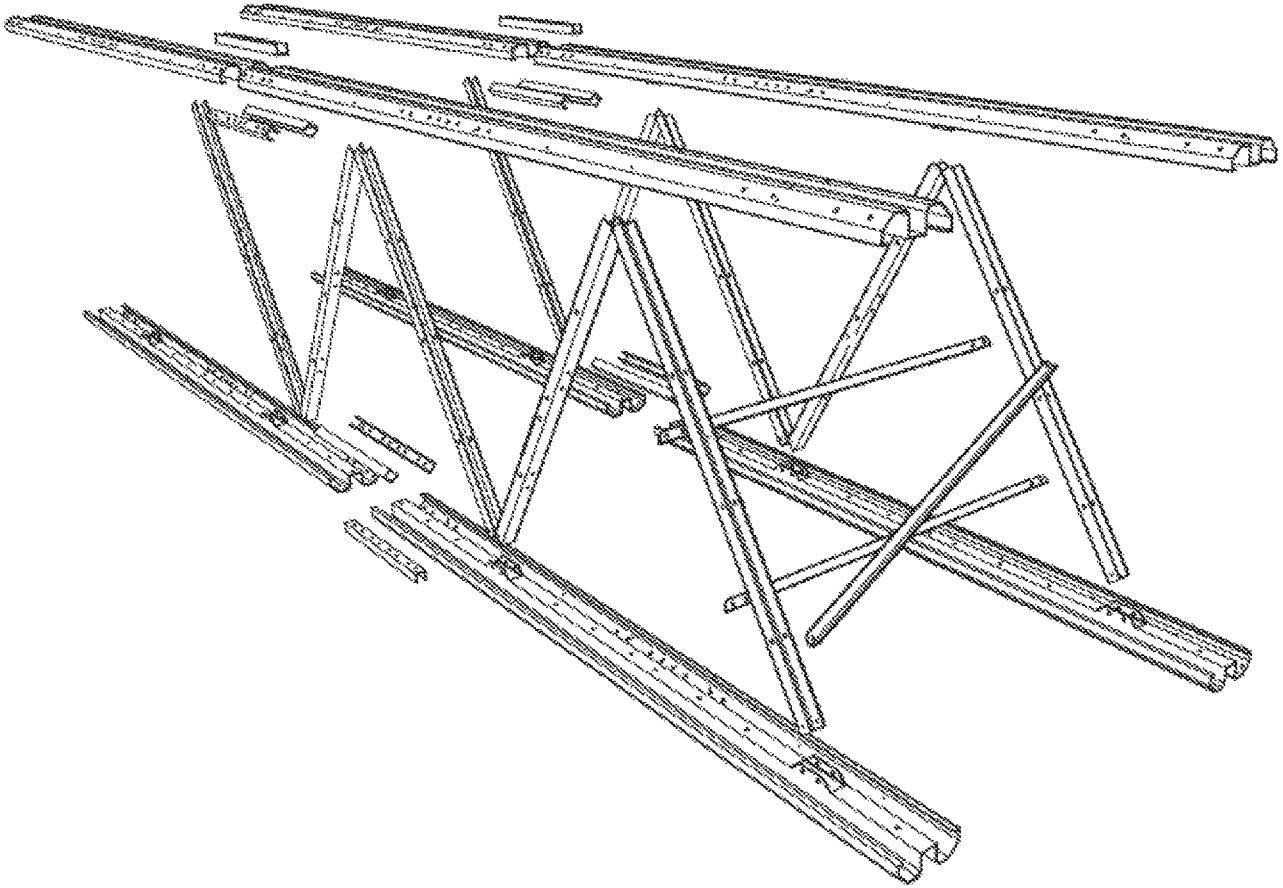
Fig. 1.1

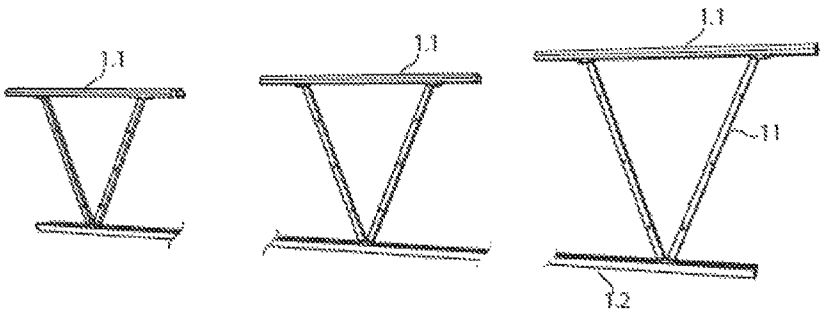
Fig. 7
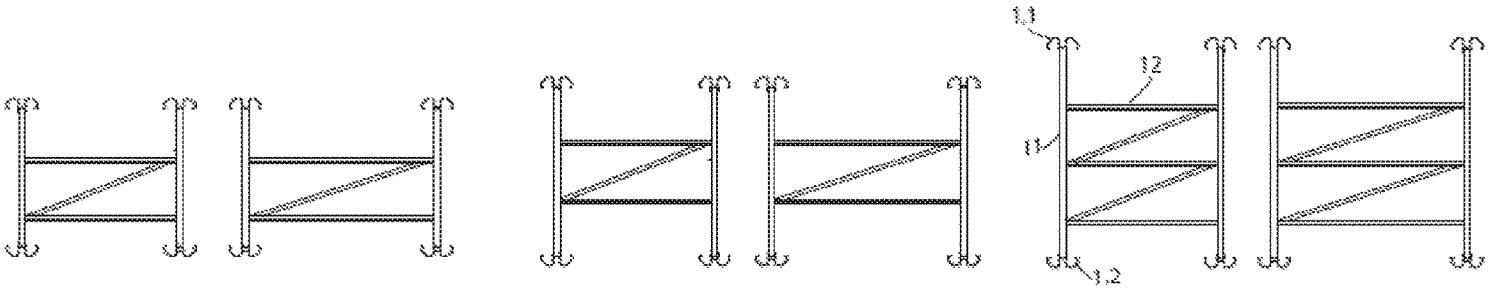
Fig. 7A
Fig. 7B
Fig. 7C a > b

ROOF TRUSS ASSEMBLY

SUMMARY OF THE INVENTION

The present invention relates to improvements in structure for coverage, in new arrangement to speed up assembly of pieces, improvements in performance of assembly and maintenance, and ease of installation in coverages.

BACKGROUND OF THE INVENTION

The object of the present invention is derived from and complements several inventions of owned by the applicant, the first configuration was filed with INPI on Aug. 21, 1978 (PI 7805402-8), the second on Sep. 9, 1985 (PI 8504326-5), the third on Feb. 5, 1991 (PI 9100456-0), the fourth on Nov. 5, 1993 (PI 9304495-0), and the last on Mar. 27, 1996 (PI 9601145-9).

The previous configurations aim to provide a result with focus on practicality and simplicity of assembly and installation of a coverage, having as a structure an arrangement of pieces assembled in modular fashion, with dedicated application to Coverage System which comprised, as one of its main elements, the arrangement of tile upon unrolling a coil of steel, aluminum or other resilient materials using the system initially disclosed in PI 7805402-8, over a predefined structure, preferably made of steel.

Said system, much identified by the system initially disclosed in PI 7805402-8, comprised a structure focused only on this application (in coil tile), not comprising the possibility of using conventional tiles, including constituting a restrictive element of the structure in question.

The object of the present invention has as the main focus, through changes in the construction of the main piece (stringer), to expand the possibility of use of other elements in conjunction with the traditional system, to be modular as to the size and arrangement of pieces, and to allow the application of other types of tile.

DESCRIPTION OF THE INVENTION

The main object of the present invention comprises a structure for coverage formed by several structural elements, in particular a main element comprising a piece (stringer), with substantial improvements in relation to the previous art with several reflexes in the structure for coverage of the present invention.

Said piece (stringer) was previously manufactured in 3 parts and at present this is done with a single integrated piece, more specifically in its function of beam element in a structure for coverage.

Said piece (stringer), hereinafter referred to as only stringer comprises in its basic embodiment a steel plate about 1.5-2 mm thick, conformed in a continuous process, said format essentially longitudinal, comprising several holes and pairs of fins in its extension, arranged modularly in a characteristic fashion.

Said stringer can manifest in several lengths, imparting a basic pattern of holes and pairs of fins in its extension.

Said fins are arranged in a single face of stringer and said holes are arranged in various faces of stringer according to its specific use.

Said fins have further holes for connection with structural piece, named diagonal, which function is to connect two stringers to one another forming a beam. Said diagonal piece receives cross-members connecting two beams to each other, and in succession, forming a structural plan.

The diagonal comprises a plurality of holes, 2 (two) holes in each of its ends for attachment in respective holes of stringer fins, and up to 10 (ten) holes, up to 6 (six) holes are used for attaching the pieces called cross-members (cited above), the number of fixing points of cross-members varying as a function of the length of the diagonal, i.e., if the diagonal length increases consequently it increases the height of the beam, imposing stiffeners, being enough to support it to put another layer of cross-members. It is further provided the use of counter-diagonals and/or supporting pieces in cascade, attached to the diagonals by other unused holes for fastening the diagonal to the fins and the cross-members to the diagonal.

Up to 6 (six) holes allow to make the connection of up to two levels of cross-members which, in turn, connect one beam to another, and having as a function, in addition to a more efficient distribution of loads, to determine precisely the distance between the beams and keep the stringers vertical and in perfect parallelism to one another.

Said stringer further has holes used for installation, assembly and attachment of structural and coverage pieces, said holes being arranged on the entire length of the body of the piece, in a characteristic spacing.

The specific arrangement of some of the above-mentioned holes along the stringer also allows said piece to be appropriately sectioned for subsequent longitudinal seam with another stringer, that seam made through connecting plates. By appropriately sectioned, we mean to apply a cross-section, in the central section of the stringer, equally spaced from two pairs of fins.

Said connecting holes are present in three faces of stringer in a characteristic arrangement.

In addition to connecting holes, said piece has other holes for accommodating and installing structural pieces or coverage.

In the upper stringer, the following use of the holes is applied:

- rectangular holes in the longitudinal direction, in the region of the fins, specific for fixing by cap support attachments pieces of caps proper for the system initially disclosed in PI 7805402-8;
- holes in two of the faces of the stringer used for fixing straps, suitable for the system initially disclosed in PI 7805402-8;
- holes in two of the faces of the stringer that can be used for fixing tiles or supports in a transverse direction to said piece.

In the bottom stringer, in principle all the holes of the faces of the piece can be used for various installations such as lighting elements, liners, sprinklers, etc., without prejudice to the use of said holes dedicated to the connection between stringers.

The present invention improves the longitudinal connection of the pieces (stringer) being performed through pieces called connecting plates.

Said connecting plates have holes also characteristic, appropriate to the holes of the piece (stringer) allowing, by the joint of stringers, any length required in design, and do make counter-deflection in the beam, for a desired structural performance.

One of the goals of present invention also comprises improvements in the transportation of the stringers to the sites where they will be mounted, allowing to take benefit of all the load capacity of the means of transportation.

The various pieces that are fixed or supported by the piece (stringer) are part of the structure or the finish of the coverages, such as diagonals and cross-members, caps, tiles, supports, coils and straps, gutters, chimneys, ventilation fans, exhaust fans, special supports for walkways, with possibility of passage of cables, wires, ducts, conduits, liners, insulators, and other elements, normally present in coverages.

The object of the present invention, in an embodiment of application, characteristic to the system initially disclosed in PI 7805402-8, uses coils of different size, allowing the creation of product models with the same concept, which optimizes the performance of structural pieces, making the product more economical, appropriate to the market requests, safe and practical.

Thus, the present invention reiterates the characteristics of practicality and modulation of the original invention, and effectively comprises an improvement with respect to the prior art.

DESCRIPTION OF THE FIGURES

FIG. 1.1 refers to an exploded view, in perspective, of the structure for coverage of present invention;

FIG. 7 refers to an illustration of constructive embodiments in three different heights;

FIGS. 7A, 7B and 7 c shows assembling embodiments of the present invention in different three heights and two widths.

Figure 12A:
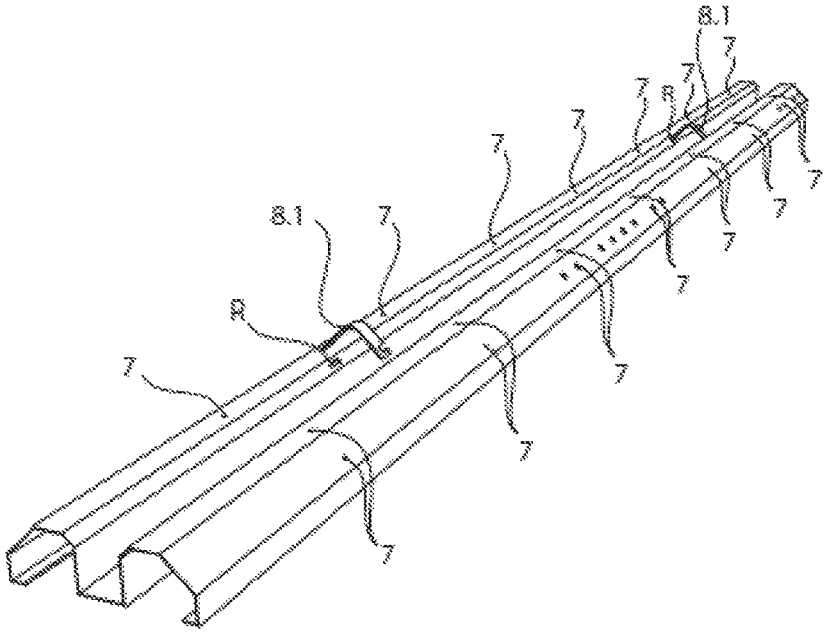
FIGS. 12A, 12B, 12C refer the views of top stringer illustrating the use of the holes as described below.
Figure 12B:
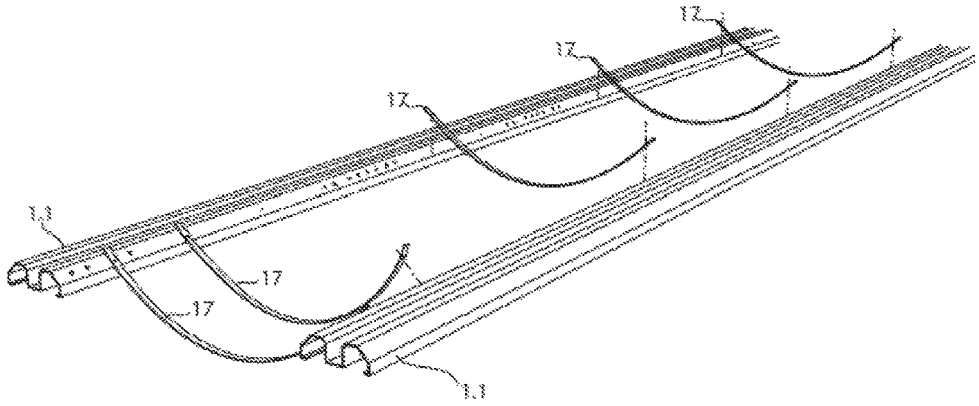
Figure 12C:
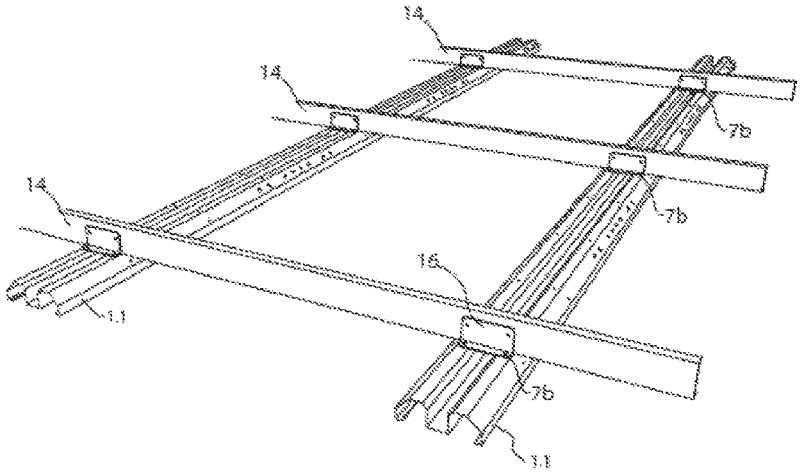
Figure 13A:
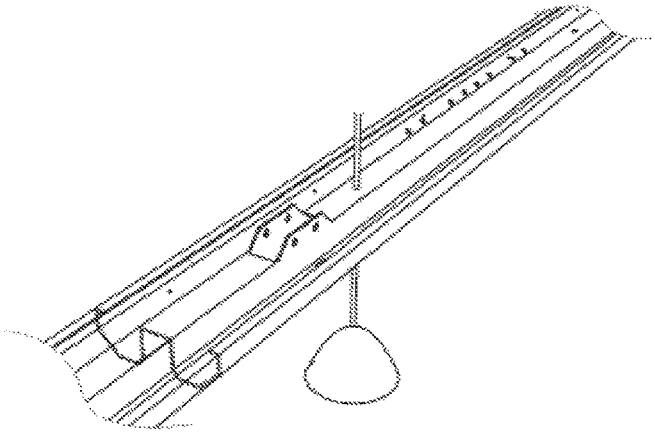
Figure 13B:
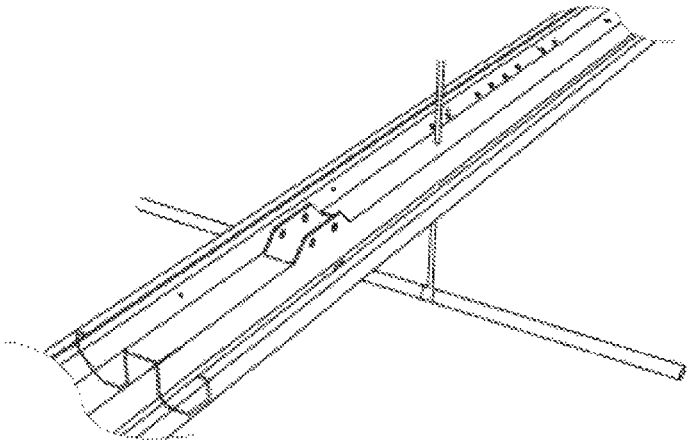

rectangular holes in the longitudinal direction, in the region of the fins, specific for fixing by cap support attachments pieces of caps proper for the system initially disclosed in PI 7805402-8 (FIG. 12A);

holes in two of the faces of the piece (stringer) used for fixing straps (17), suitable for the system initially disclosed in PI 7805402-8 (FIG. 12B);

holes in two of the faces of the piece (stringer) that can be used for fixing tiles or supports in a transverse direction to said piece, upon using the attachment piece (16) (FIG. 12C);

FIGS. 13A and 13B refer to a view of the bottom stringer illustrating the use of the holes as described, that is, all the holes of the faces of the piece can be used for various installations, such as lighting elements, liners, sprinklers, etc., without prejudice to the use of said holes dedicated to the connection between stringers.

Figure 14A:
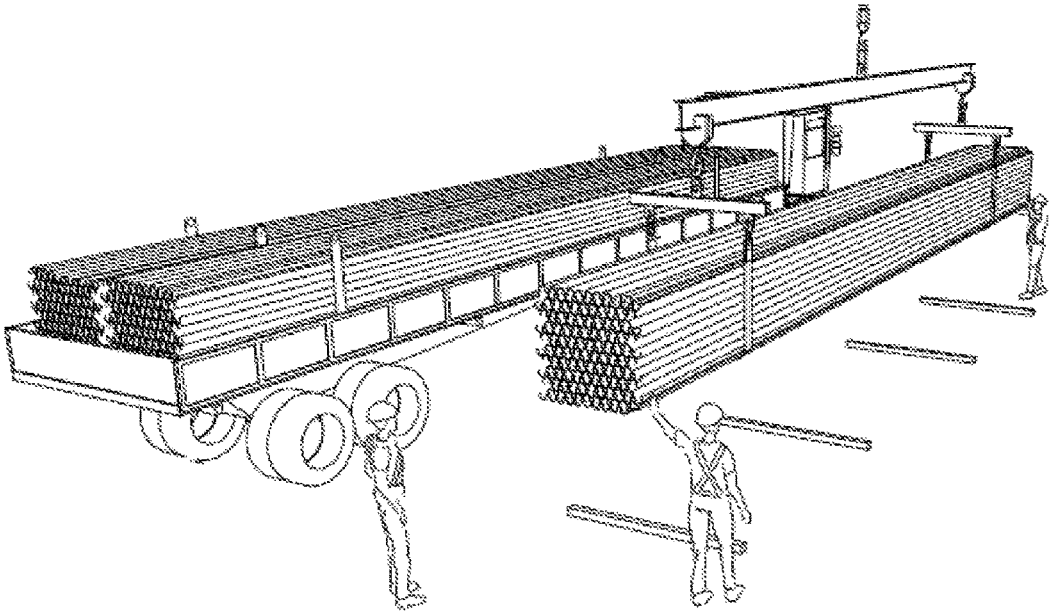
Figure 14B:
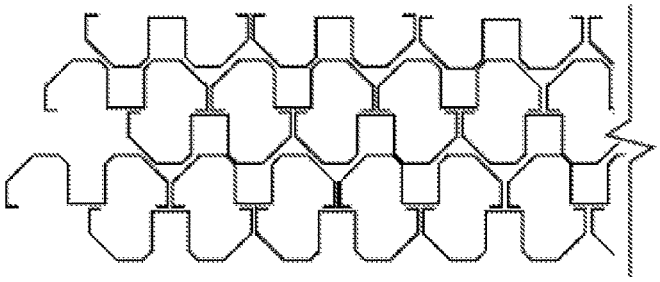

FIGS. 14A and 14B illustrate ways of stacking and transporting the stringer.

FIGS. 15A, 15B, 15C and 16 show the use of tiles and supports in the structure for coverage of the present invention.

Figure 17:
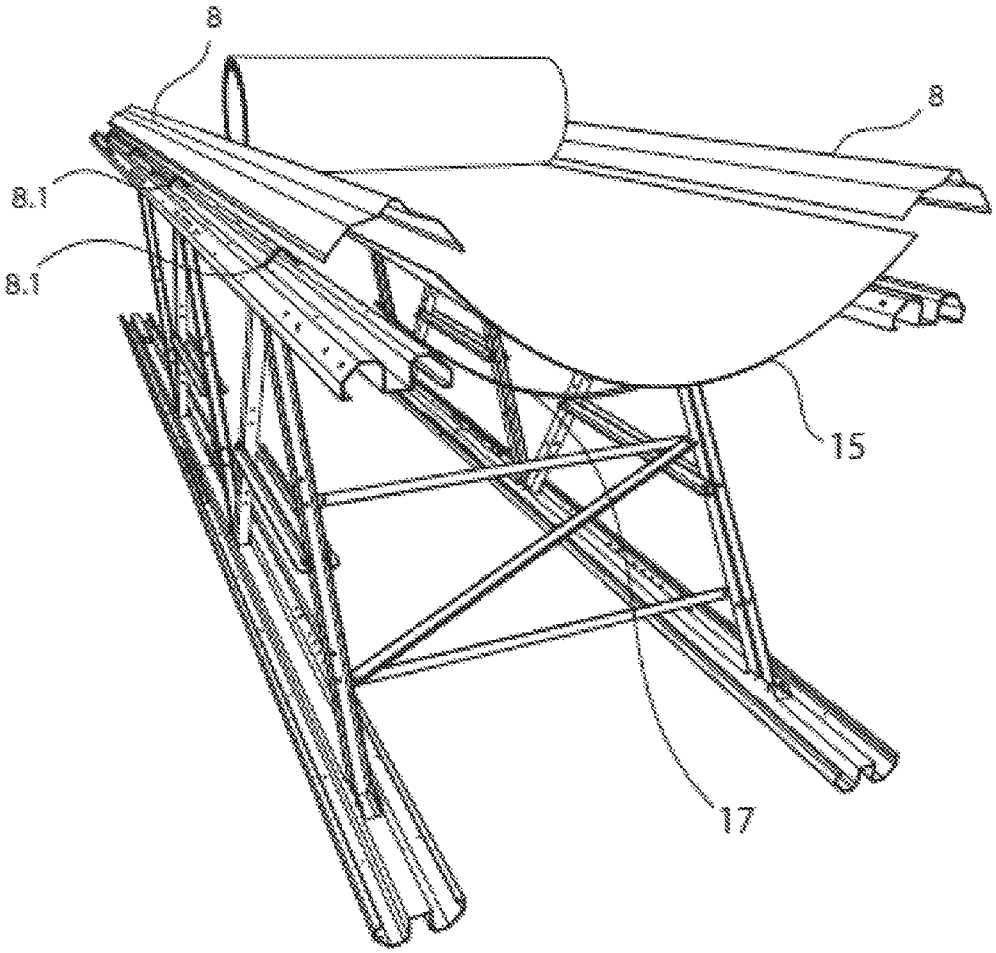
Figure 18:
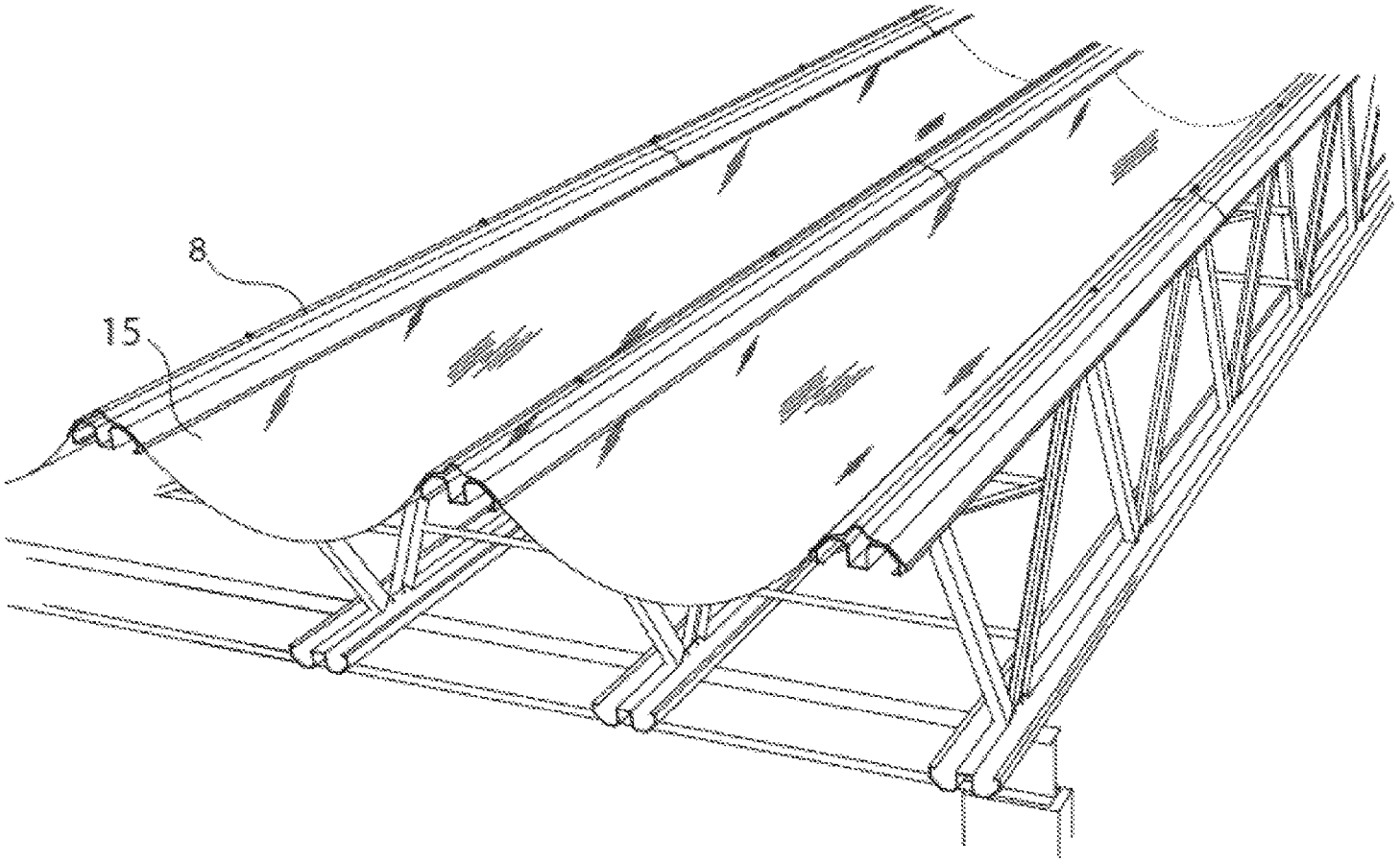

FIGS. 17 and 18 shows the use of tiles in coil (15) embodiment in the structure for coverage of the present invention.

DESCRIPTION OF THE ELEMENTS OF THE FIGURES

For a better understanding of the present invention, it is presented the following list of elements and/or components:

1—stringer
1.1 upper stringer
1.2 bottom stringer
2 beam (stringer+diagonals), or module
3 structure (stringers+diagonals+cross-members)
4 counter-diagonal
5 holes of stringer (larger diameter)
6 connecting plate
7 holes of stringer (smaller diameter)
R hole of stringer (rectangular)
8 cap
8.1 cap support
9 fins
9*a*, 9*b* holes of the fins
10 holes of the connecting plates (larger diameter)
i holes of the connecting plates (for identification)
11 diagonal
12 cross-member
13 tile
14 support
15 coil
16 attachment piece of support

DETAILED DESCRIPTION OF THE INVENTION

All these items for improvement of the system will be described in detail, with reference to the drawings attached below.

The main object of the present invention comprises a structure (3) for coverage formed by various structural elements, in particular a main element comprising a piece (stringer) (1), with substantial improvements in relation to the prior art with various reflections in the structure (3) for coverage of the present invention.

Said stringer (1), comprises in its basic embodiment a steel plate about 1-2 mm thick, conformed in a characteristic fashion by a tool in a continuous process, that shape essentially longitudinal, comprising several holes (5, 7, R) and pairs of opposing fins (9), also known as shields, in its extension, arranged modularly in a characteristic way in a basic pre-determined pattern.

Said piece (stringer) (1) can contemplate different lengths, being connected to one another by connecting plates (6) of characteristic geometry.

Said stringer (1) has thirteen faces or segments (a lateral segment 101, a parallel segment 102, a first angled segment 103, a bottom segment 104, a second angled segment 105, a parallel segment 106, a parallel segment 107, a second angled segment 108, a bottom segment 109, a first angled segment 110, a parallel segment 111, a lateral segment 112 and a connection segment 113), the holes (5, 7, R) being arranged in the first angled segment 103, 110, the second angled segment 105,108, the bottom segment 104, 109, and the connection segment 113. Said faces are shown in FIGS. 2 (2A, 2B, 2C and 2D) to 3 (3A, 3B, 3C and 3D).

FIGS. 1, 5, 6, 7A, 7B and 7C illustrate the arrangement of cross-members (12) and diagonals (11) for forming the structure (3) for coverage of the present invention, showing holes for fixing the diagonals (11) and cross-members (12), three heights and constructive embodiments different from each other.

Said holes allow the diagonals (11) to be connected to the upper stringers (1.1) and the lower stringers (1.2); the cross-members (12) to be attached to the diagonals (11) for connecting two beams; and also to be able to be attached as counter-diagonals (4) between diagonals (11), when used.

FIGS. 7A, 7B and 7C show assembling embodiments, showing beams of different heights and widths with its specific diagonals (11) and respective cross-members (12). As evidenced, it is enough to change the length of the diagonals (11) to change the height of the beams and, consequently, the spans that they cover; or change the length of the cross-members (12) to obtain a greater spacing between the beams. FIGS. 7A, 7B and 7C also illustrate the fact they can position and/or add more cross-members (12) to connect the beams when they are too high, with very long diagonals (11).

Figure 8A:
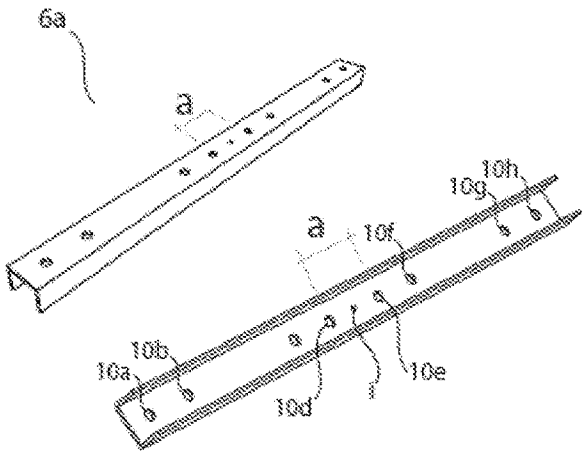
FIGS. 8A and 8B refer to top and bottom perspective views of each of the connecting plates.
Figure 8B:
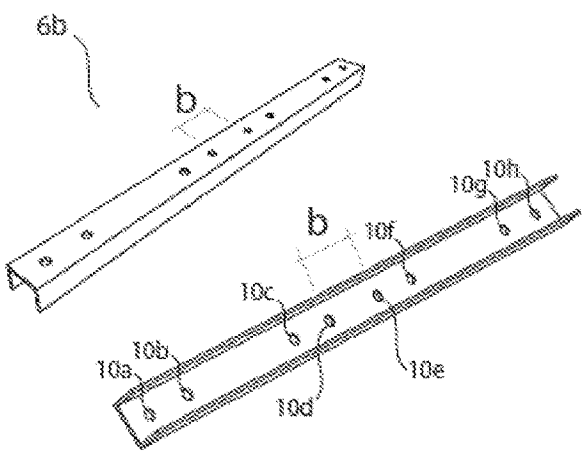
Figure 8C:
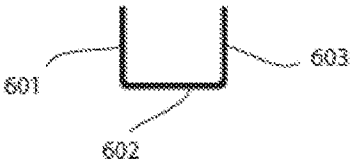
FIG. 8C refers to the cross-section of the connecting plate.
Figure 9A:
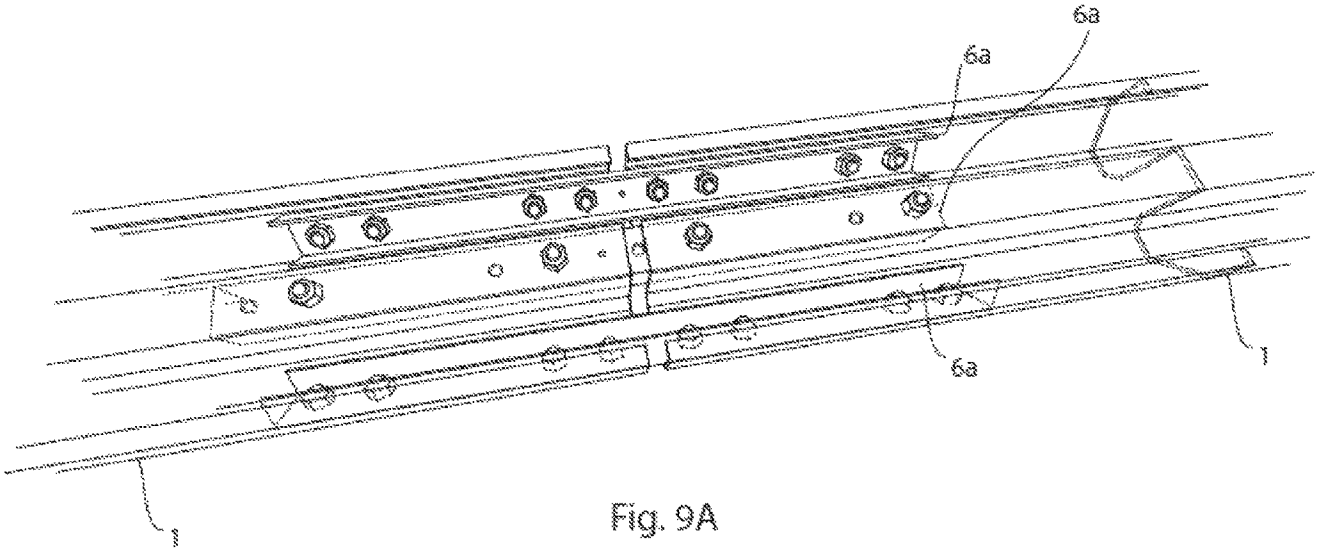
FIG. 9A refers to a view of the connecting plates bolted to the stringer.
Figure 9B:
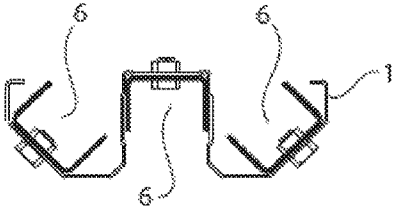
FIG. 9B refers to the cross-sections of the stringer and connecting plates on the connection showing the connecting plates.
Figure 10:
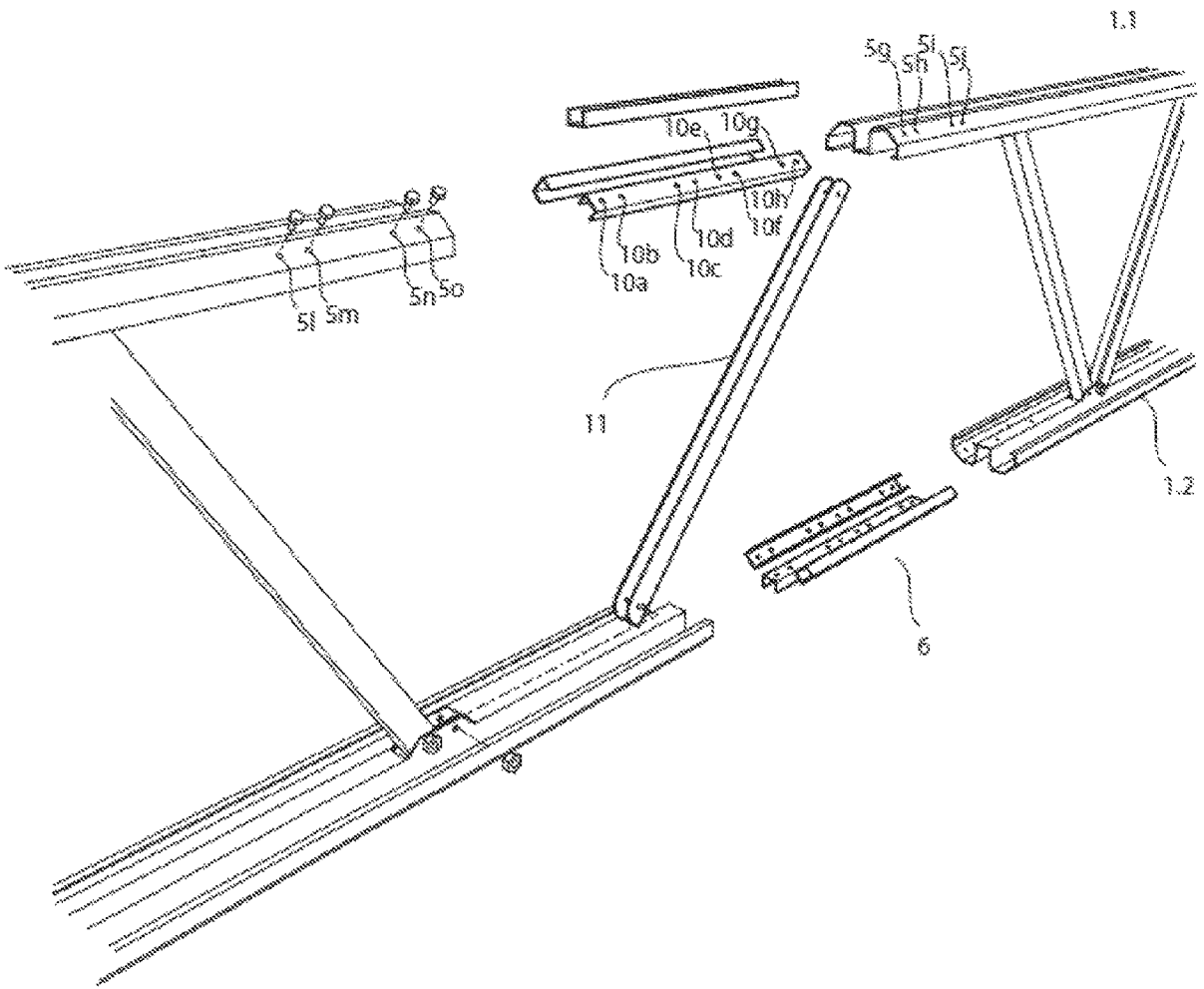
FIG. 10 refers to a perspective view of the assembling/connection of two stringers through the placement of connection plates.

The structure (3) for coverage of the present invention further comprises connecting plates (6*a*, 6*b*), shown in FIGS. 8A, 8B, 8C, 9A and 9B, which are arranged inside the stringer (1) and connect a stringer (1) to another at their ends. Said connecting plates (6*a*, 6*b*) have a 'U' shape and are inserted inside the stringer (1), as shown in FIGS. 9A, 9B and 10.

Said connecting plates (6*a*, 6*b*) with 'U' shape, as shown in FIG. 8C, have connecting plate holes (10*a*, 10*b*, 10*c*, 10*d*, 10*e*, 10*f*, 10*g*, 10*h*) in only one their connecting plate bottom segment (602), said connecting plate holes (10*a*, 10*b*, 10*c*, 10*d*, 10*e*, 10*f*, 10*g*, 10*h*) being arranged centrally in said connecting plate bottom segment (602), in a longitudinal direction, and in a characteristic spacing.

Said connecting plate holes (10*a*, 10*b*, 10*c*, 10*d*, 10*e*, 10*f*, 10*g*, 10*h*) of connecting plates (6*a*, 6*b*), as shown in FIGS. 8A and 8B, are previously determined as a function of the holes (5) of the stringer (1). The holes (5, 7, R) of the stringer (1) are arranged in different faces, namely:

in the connecting segment (113) with opposing fins (9) are arranged six connection segment holes (5*a*, 5*b*, 5*c*, 5*d*, 5*e* and 5*f*), three connection segment holes (5*a*, 5*b* and 5*c*) are arranged, then opposing fins (9) are arranged and thereafter, the remaining three connection segment holes (5*d*, 5*e* and 5*f*), in the bottom segments (104 and 109), four bottom segment holes (7*a*, 7*b*, 7*c* and 7*d*) are arranged and second angled segment holes of rectangular shape R are arranged in the second angled segments (105 and 108), a first pair of said bottom segment holes (7*a*, 7*b*) being separated by a second angled segment hole (R) from a second pair of said bottom segment holes (7*c* and 7*d*); and in the first angled segments (103 and 110) twelve first angled segment holes are arranged, four first angled segment holes (7*e*, 7*f*, 7*g* and 7*h*), and eight first angled segment holes (5*g*, 5*h*, 5*i*, 5*j*, 5*l*, 5*m*, 5*n* and 5*o*);

For purposes of exact understanding of the object of the present invention, it was determined a section of the stringer (1) that, in spite of being a continuous piece capable of varying size, shows a characteristic pattern that can be observed in FIGS. 2A, 2B, 2C and 2D.

The present invention further comprises opposing fins (9) arranged on the connection segment (113) of stringer (1), said fins (9) being formed at predetermined intervals and arranged centrally in the stringer (1).

Figure 4:
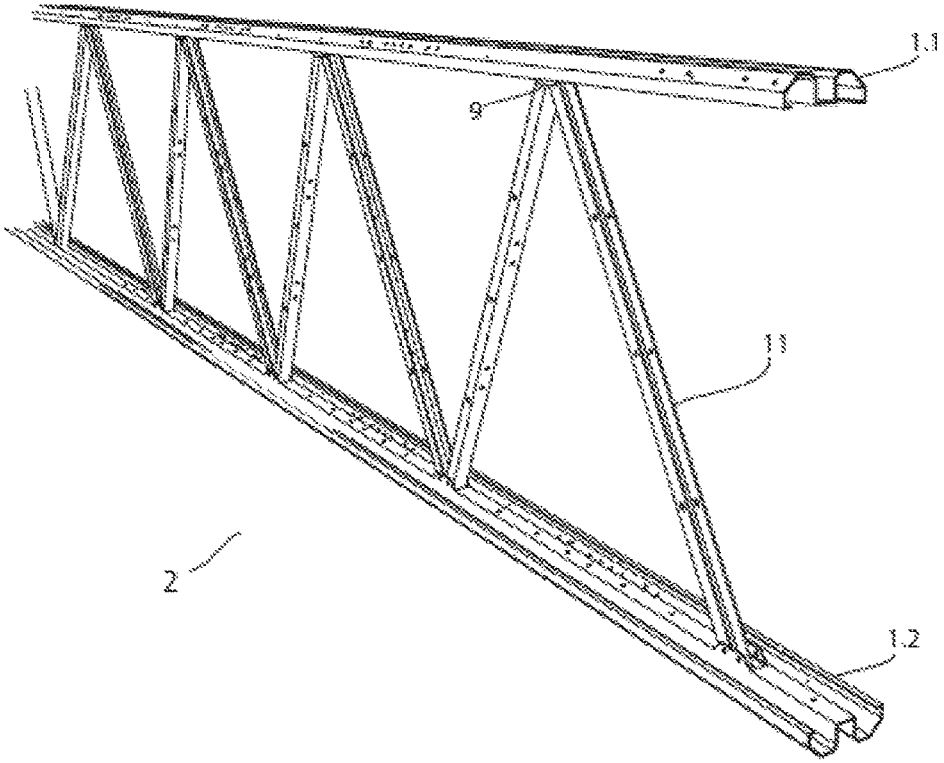
FIG. 4 refers to a perspective view of the assembly of upper and lower stringers with diagonals.
Figure 5:
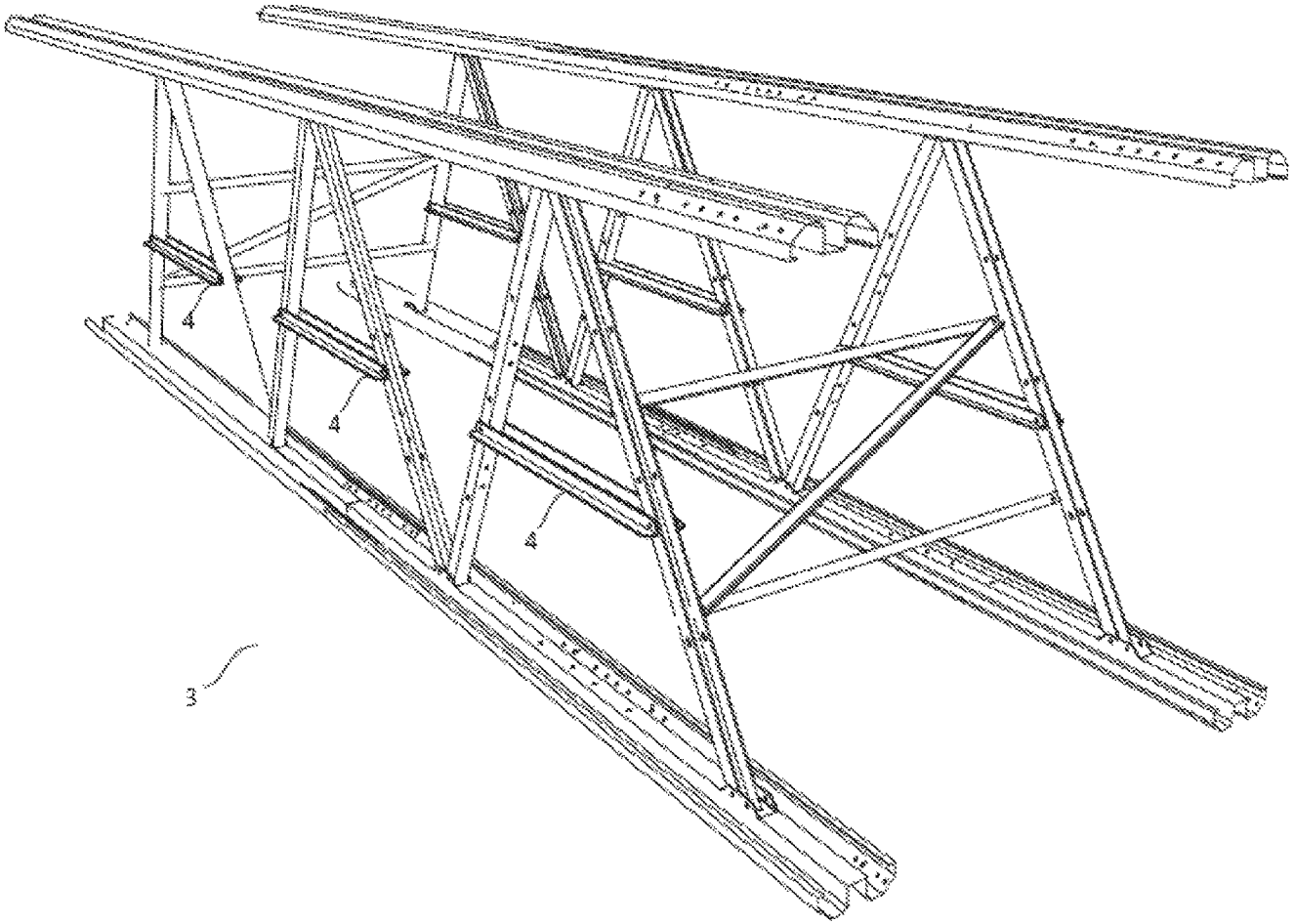
FIG. 5 refers to a perspective view of the assembly of upper and lower stringers with diagonals, counter-diagonals and cross-members, demonstrating the counter-diagonal.
Figure 6:
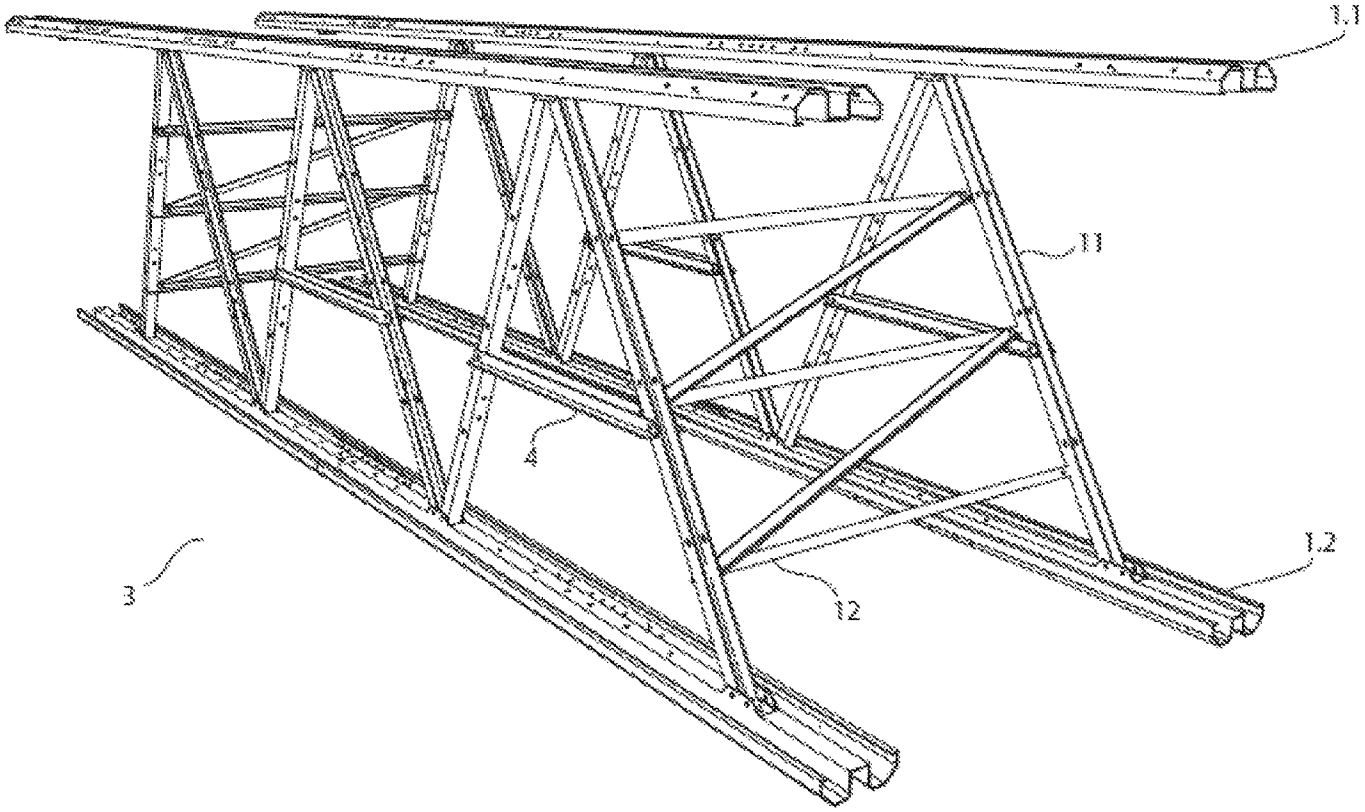
FIG. 6 refers to a perspective view of the assembly of upper and lower stringers with elongated diagonals, counter-diagonals and cross-members, demonstrating the counter-diagonal.

Said opposing fins (9) further have fin holes (9*a*, 9*b*) for connection with a structural piece, called diagonal (11), whose function is to connect two stringers (1.1, 1.2) to one another forming a beam (2), as shown by FIG. 4. Said diagonal piece (11) receives further cross-members (12) connecting two beams (2) to one another and in succession forming a structural plan.

As evidenced by FIGS. 8A, 8B, 9A, 9B and 10 connection segment holes (5*a*, 5*b*, 5*e* and 5*f*) of the connection segment (113) of stringer (1) and the first angled segment holes (5*g*, 5*h*, 5*i*, 5*j*, 5*l*, 5*m*, 5*n* and 5*o*) arranged on the the first angled segment (103 and 110) are used as longitudinal seam holes for aligning connecting plates (6), which connecting plate holes are arranged in a way to promote the connection by bolts between the stringer (1) and the connecting plates (6).

The characteristic, standardized and repetitive arrangement of holes (5, 7, R) of the stringer (1) allows producing various lengths of this piece, simply cutting the stringer (1) in the middle of the distance between any two fins (9). The piece produced can be united longitudinally to another stringer (1), since the holes at the end from the cutting of stringer (1) coincide exactly with the connecting plate holes in the corresponding end of the connecting plate (6), which will make the joint.

As can be seen from FIGS. 8A, 8B and 8C, there are two basic types of connecting plate (6*a* and 6*b*). The connecting plates (6*a* or 6*b*) are installed on the first angled segments (103, 110) and the connection segment (113) of the stringer (1), such that, connecting plates (6*a* and 6*b*) are placed on the inner wall of said first angled segments (103 and 110) of the stringer (1) and on the external wall of said connection segment (113) of the stringer (1), as shown in FIGS. 9A and 9B. In these FIGS. (8A, 8B and 8C, 9A, 9B and 10) it is evidenced connecting plate holes (10*a*, 10*b*, 10*c*, 10*d*, 10*e*, 10*f*, 10*g*, 10*h*) of said connecting plates (6*a*, 6*b*), for attaching the connecting plates (6*a*, 6*b*) to the stringers (1) for connecting two ends of stringers (1) to one another.

Said connecting plates (6*a* and 6*b*) comprise a difference in spacing between the central connecting plate holes (10*d* and 10*e*), the distance between said central connecting plate holes (10*d* and 10*e*) in connecting plate 6*a* is greater than in connecting plate 6*b*, represented by a>b, the connecting plate 6*a* comprising an identifying hole (i) for differentiation of the connecting plate 6*b*.

Figure 11A:
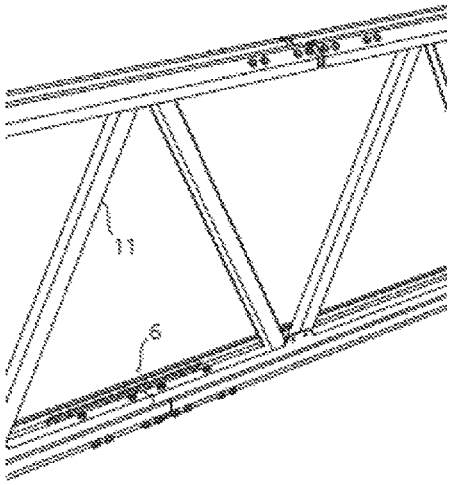
FIGS. 11A and 11B refer the views of the assembly/connection of two stringers through the placement of connecting plates, resulting in counter-deflection in the beam.
Figure 11B:
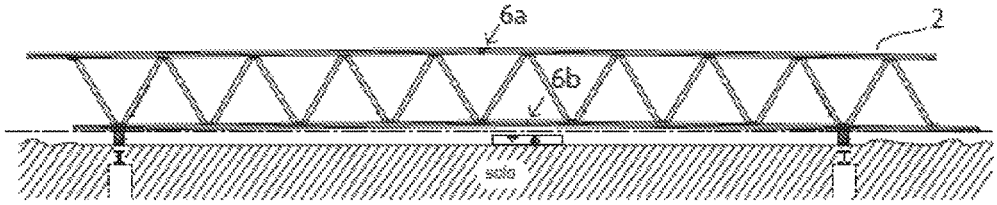

Said difference in spacing between the central connecting plate holes (10*d* and 10*e*) for the same piece aims to allow performing the effect of counter-deflection on the resulting structures (3) (see FIGS. 11A, 11B) upon installation of the connecting plate 6*a* on the first angled segments 103, 110 and the connection segment 113 of upper stringer (1.1) and the connecting plate 6*b* on the first angled segments 103, 110 and the connection segment 113 of lower stringer (1.2) for the purpose of formation the counter-deflection once the connecting plate 6*a*, being substantially larger lengthwise than the connecting plate 6*b*, causes the stringers (1), in union, to keep their ends separated when using the connecting plate 6*a* and united when using the connecting plate 6*b* (see FIG. 11A).

A constructive characteristic of stringer and connecting plate lies in the fact the connecting plate holes of the connecting plate to be installed and fastened to the connection segment holes contained in the connection segment 113 of stringer (1) comprise an apparent mismatch.

The first angled segment holes contained in the first angled segments 103 and 110 of stringer (1), further to being present in greater number, are in different positions of the connection segment holes contained in the connection segment 113, for which reason it is seen an apparent mismatch between the installation of the same connecting plate on the first angled segments 103 and 110 and on the connection segment 113, for maintenance of the standardization of connection plate.

The seams in the stringer (1) are highlighted by FIGS. 9A, 9B and 10.

Said FIG. 10 illustrates an exploded view of the seam point shown, besides the connecting plates (6*a* and 6*b*) in relation to upper (1.1) and lower (1.2) stringers, the arrangement of diagonal (11) between the stringers (1) at the seam point.

The stringers (1) with lengths different from the standard can be obtained cutting in half the middle of the region between any two opposing fins (9). Said cuts allow the stringer (1) so cut its connection with another stringer (1) performed by the connecting plates, enabling to ship to the construction site only stringers (1) of standard length.

Figure 1:
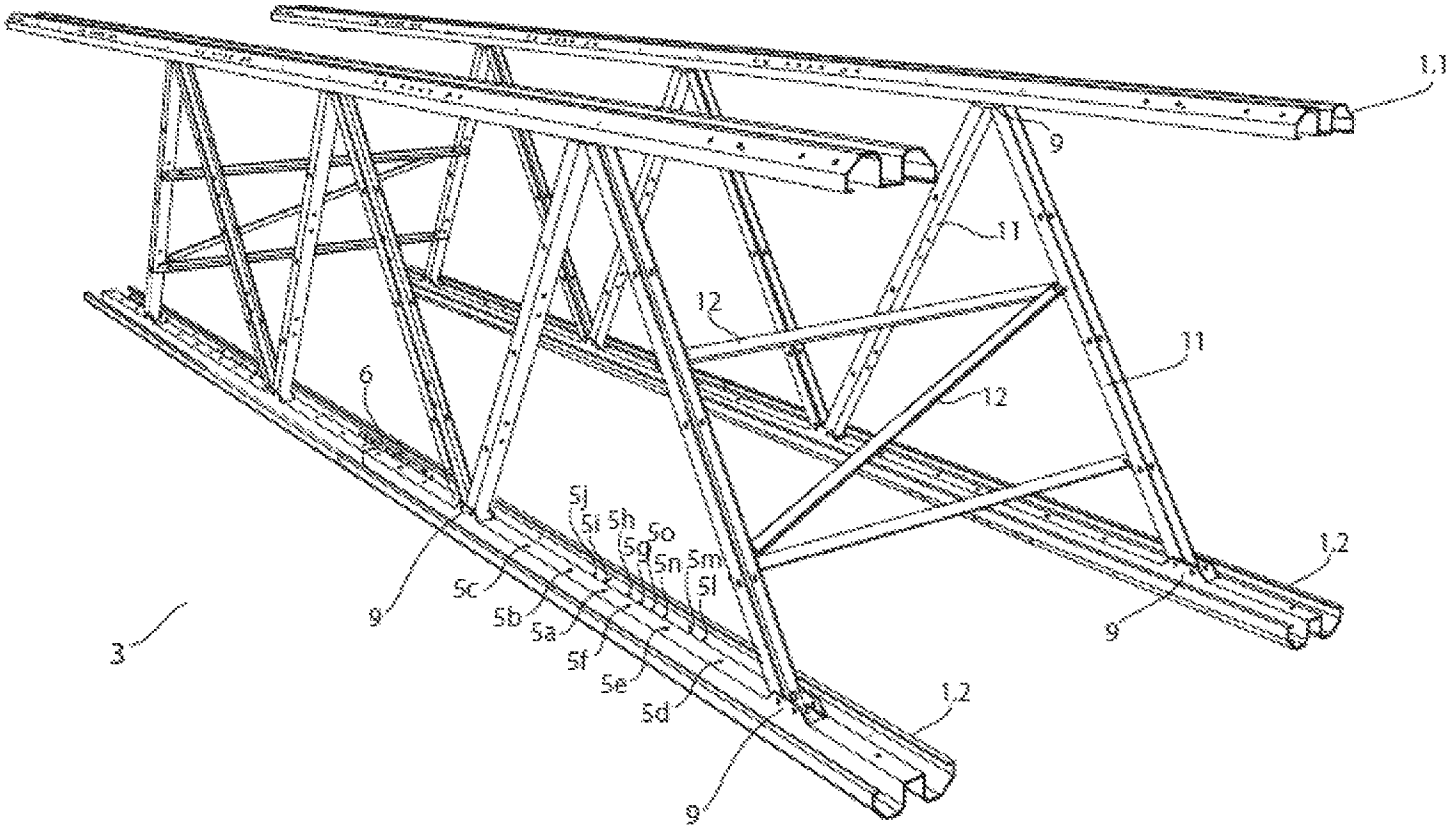
FIG. 1 refers to a perspective view of the structure for coverage of the present invention, in a basic embodiment.
Figure 2A:
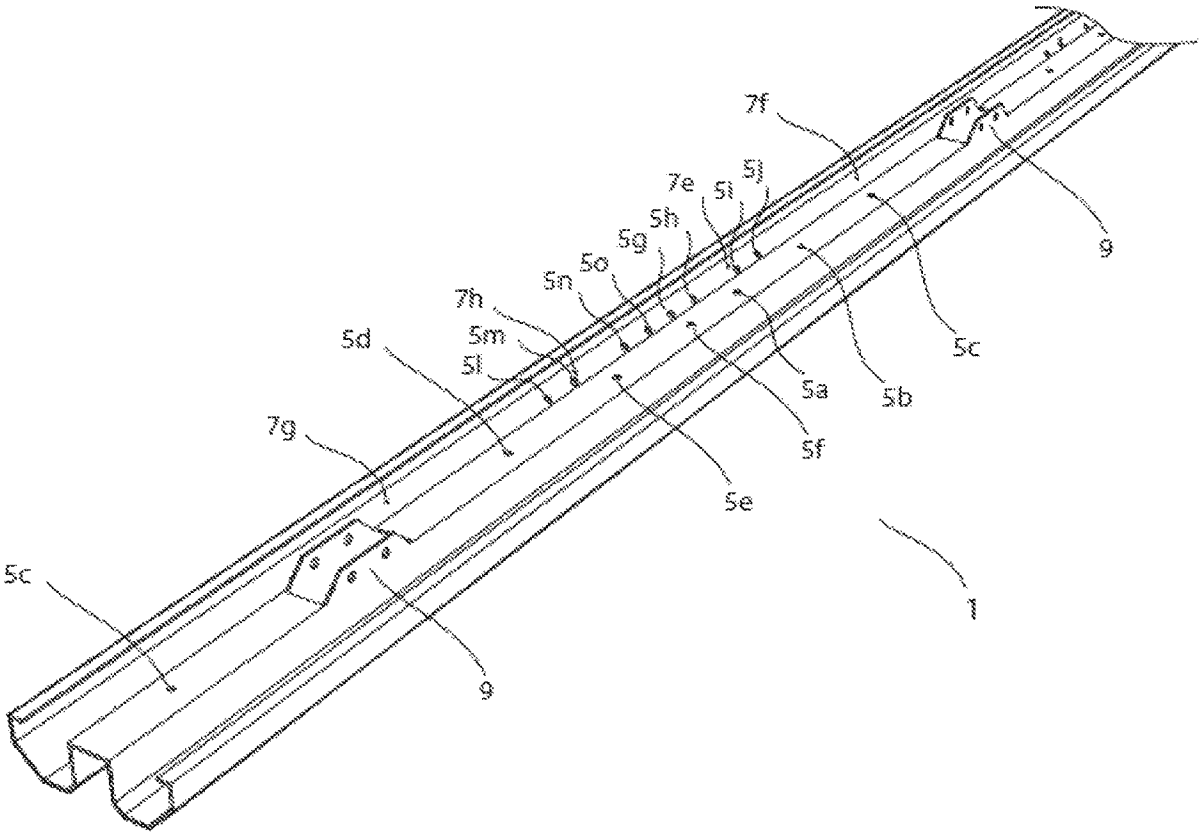
FIGS. 2A, 2B, 2C and 2D refer to views of a section of the stringer (1), with complete holes.
Figure 2B:
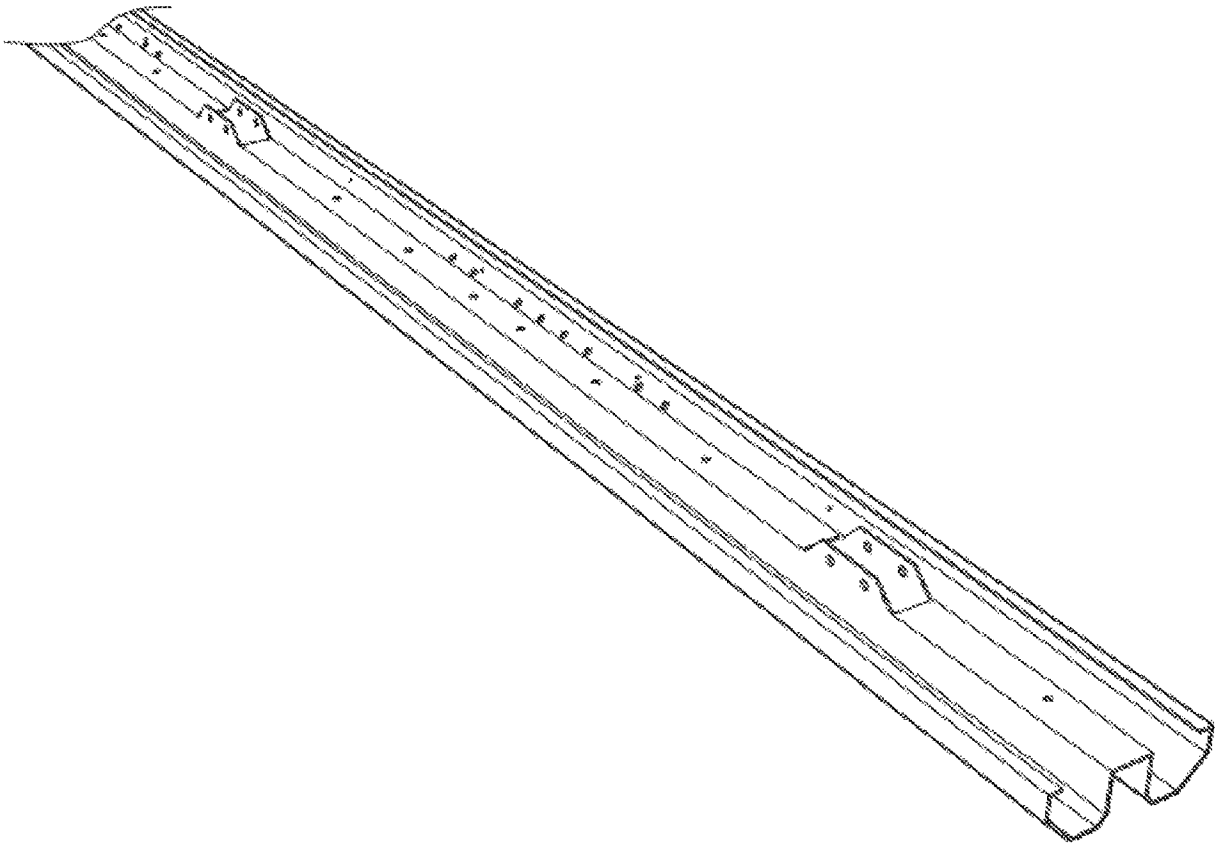
Figure 2C:
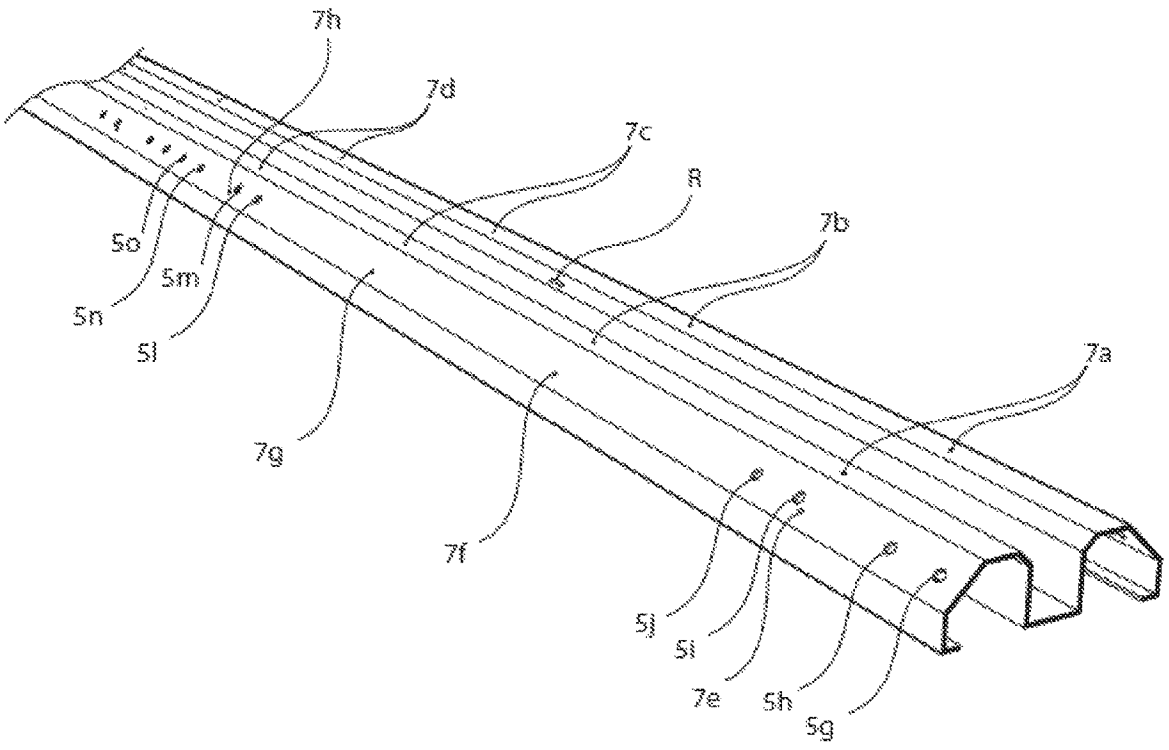
Figure 2D:
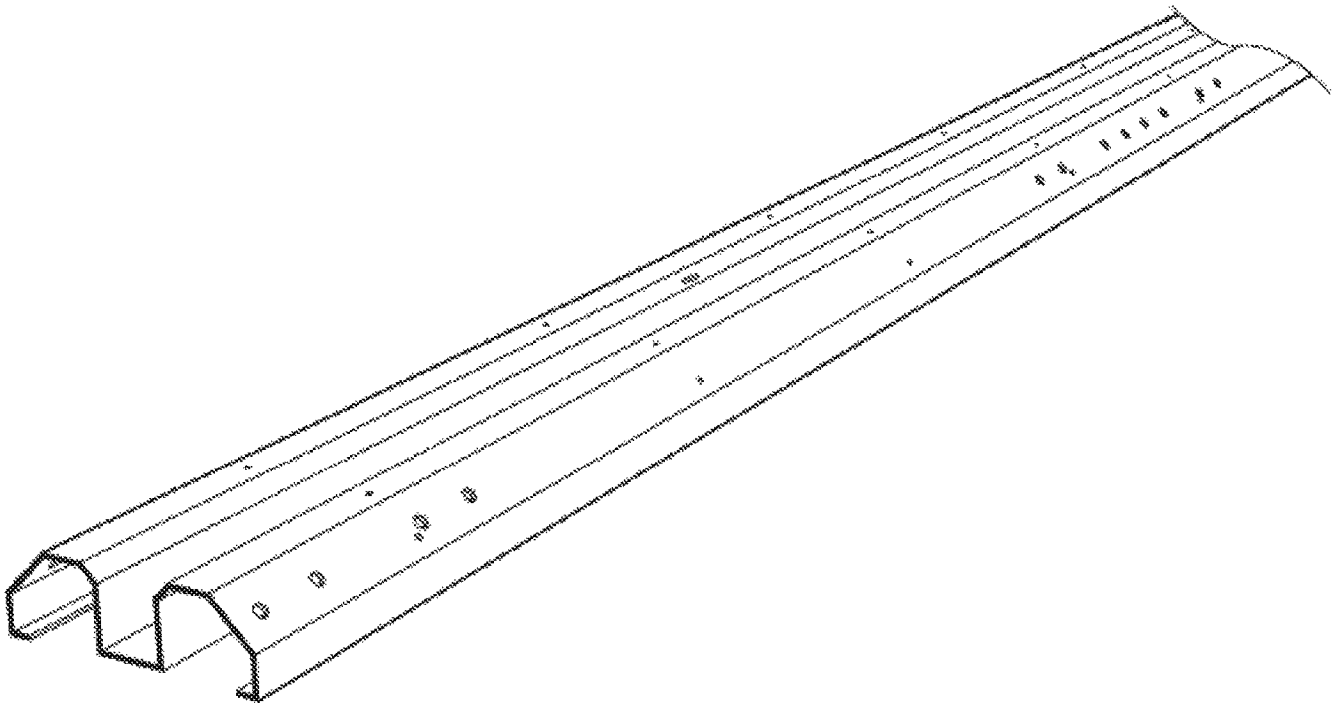
Figure 3A:
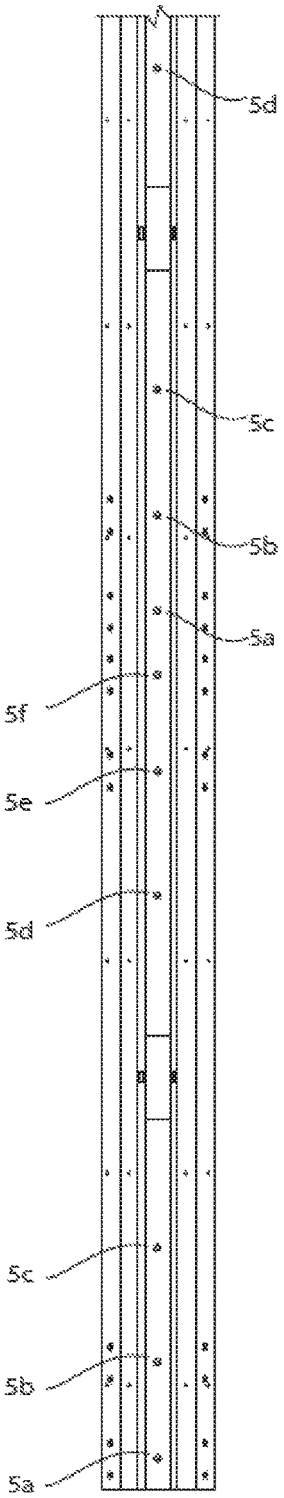
FIGS. 3A and 3B refer to upper and lower views of the stringer with complete holes.
Figure 3B:
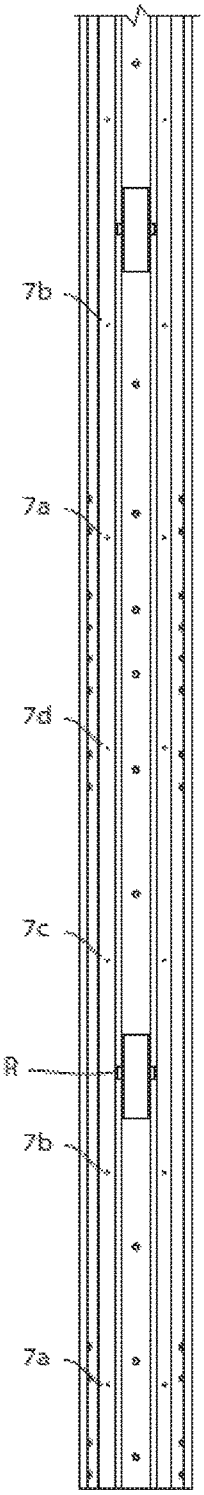
Figure 3C:
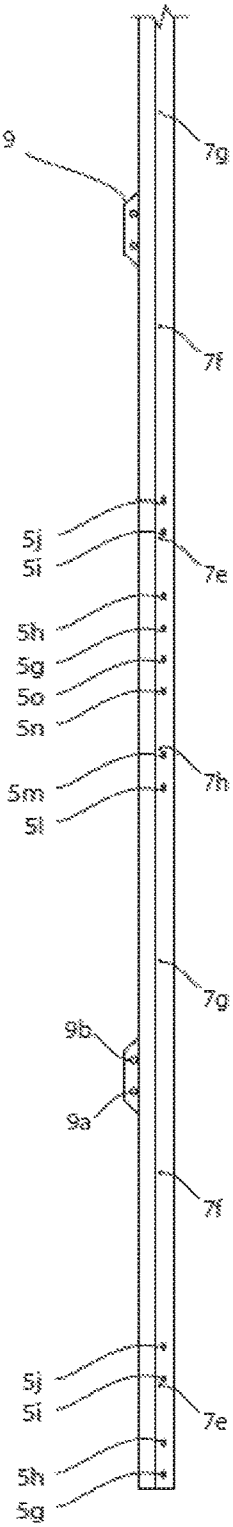
FIG. 3C refers to a side view of the stringer with complete holes.
Figure 3D:
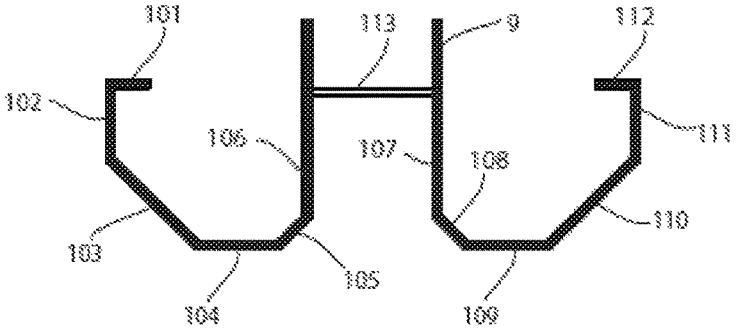
FIG. 3D refers to a front view of the stringer showing fins.

Regarding the holes of stringer (1), it is worth clarifying that with the formation of the beam (2), as illustrated in FIG. 4, you have an upper stringer (1.1) and a lower stringer (1.2) and that, as illustrated by FIG. 3A, 3B and 3C, in addition to connection segment holes (5*a*, 5*b*, 5*e*, 5*f*), first angled segment holes (5*g*, 5*h*, 5*i*, 5*j*, 5*l*, 5*m*, 5*n*, 5*o*), and multipurpose connection segment holes for installation and other applications (5*c*, 5*d*), said stringer (1) also has other holes for accommodation and installation of structural pieces for coverage or other elements (second angled segment holes R, bottom segment holes 7*a*, 7*b*, 7*c*, 7*d*, and first angled segment holes 7*e*, 7*f*, 7*g*, 7*h*), that is, all the holes that are not involved in the assembly of present structure (3) for coverage can be used for normal installations of use in buildings (lighting, sprinklers, etc.).

In the upper stringer (1.1), the holes are used as follows:

rectangular second angled segment holes (R) lengthwise in the second angled segment 105 and 108, on a side of the stringer (1) opposite the region of the fins (9), are used for attaching cap (8) by snap-fitting the attachment pieces - cap supports—(8.1), as illustrated in FIG. 12A, proper for the system initially disclosed in PI 7805402-8;

first angled segment holes 7*e*, 7*f*, 7*g*, 7*h* in the first angled segment (103, 110) of stringer (1) are used for attaching straps (17) as illustrated in FIG. 12B, proper for the system initially disclosed in PI 7805402-8;

bottom segment holes 7*a*, 7*b*, 7*c*, 7*d* in the bottom segment (104, 109) of stringer (1) that can be used for attaching tiles 13 or supports 14 in the transverse direction, as illustrated by FIG. 12C;

connection segment holes 5*c* and 5*d* of stringer (1) that can be used for various purposes. Likewise, the connection segment holes 5*a*, 5*b*, 5*e*, 5*f* and the first angled segment holes 5*g*, 5*h*, 5*i*, 5*j*, 5*l*, 5*m*, 5*n*, 5*o*, when not used for attaching connecting plates.

In lower stringer (1.2), the connection segment holes 5*c*, 5*d*, in the connection segment 113 and the bottom segment holes 7*a*, 7*b*, 7*c*, 7*d* and the first angled segment holes 7*e*, 7*f*, 7*g*, 7*h* the bottom segment 104, 109 and the first angled segment 103, 110 respectively, can be used for various installations, such as lighting elements, liners, sprinklers, etc. (see FIGS. 13A and 13B). Likewise the connection segment holes 5*a*, 5*b*, 5*e*, 5*f* and the first angled segment holes 5*g*, 5*h*, 5*i*, 5*j*, 5*l*, 5*m*, 5*n*, 5*o*, when not used for attaching the connecting plates.

The FIGS. 14A and 14B illustrate ways of packaging of stringers (1) in lots and the transport thereof to the work site. The lots are made with standard number of pieces, alternating layers of stringers (1) with a mouth up with layers with mouths down. In this way, it is used the transportation up to the weight limit of the vehicle. The pieces in lots facilitate unloading and inventory control in the work.

Figure 15A:
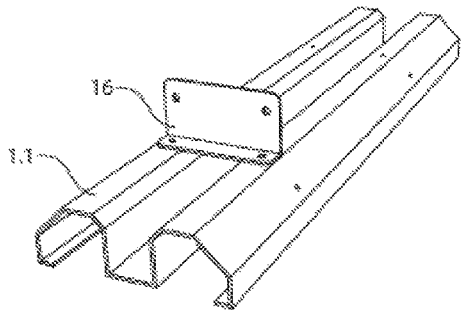
Figure 15B:
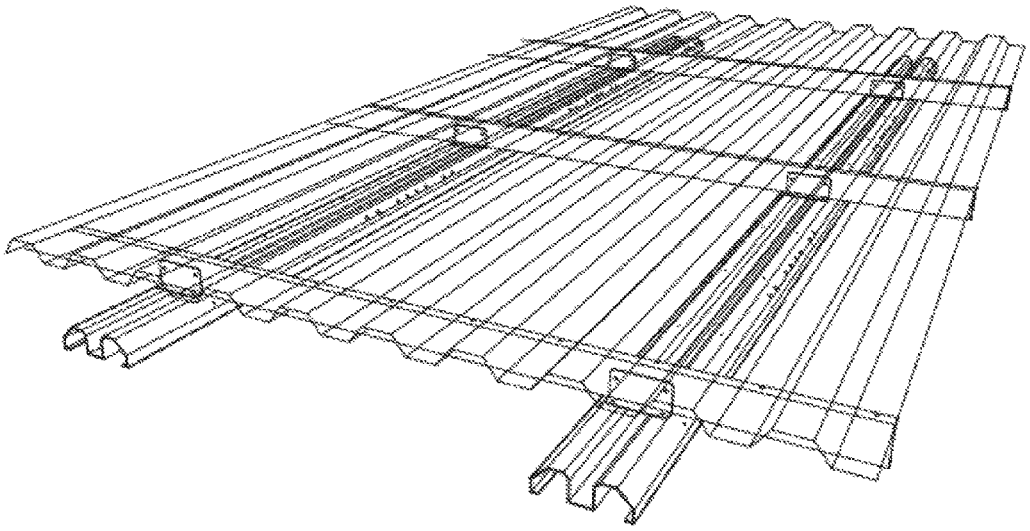
Figure 15C:
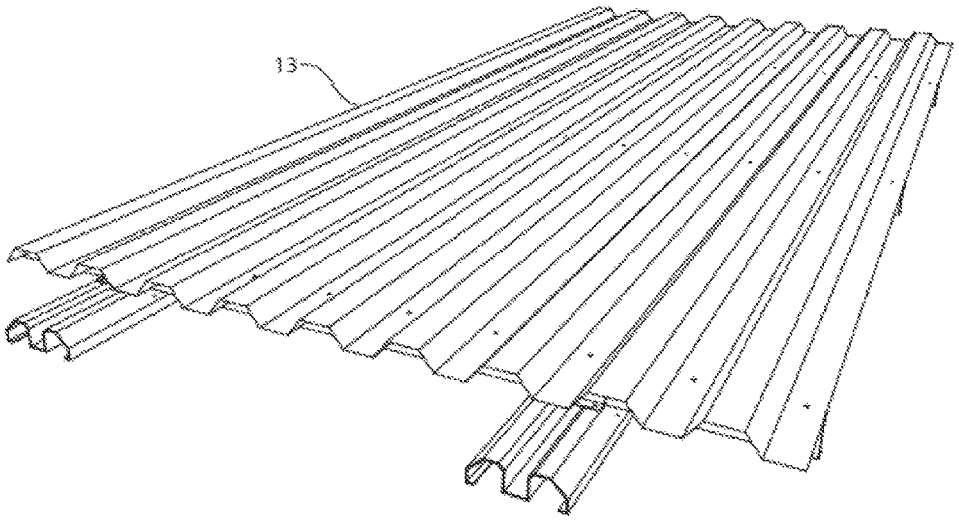
Figure 16:
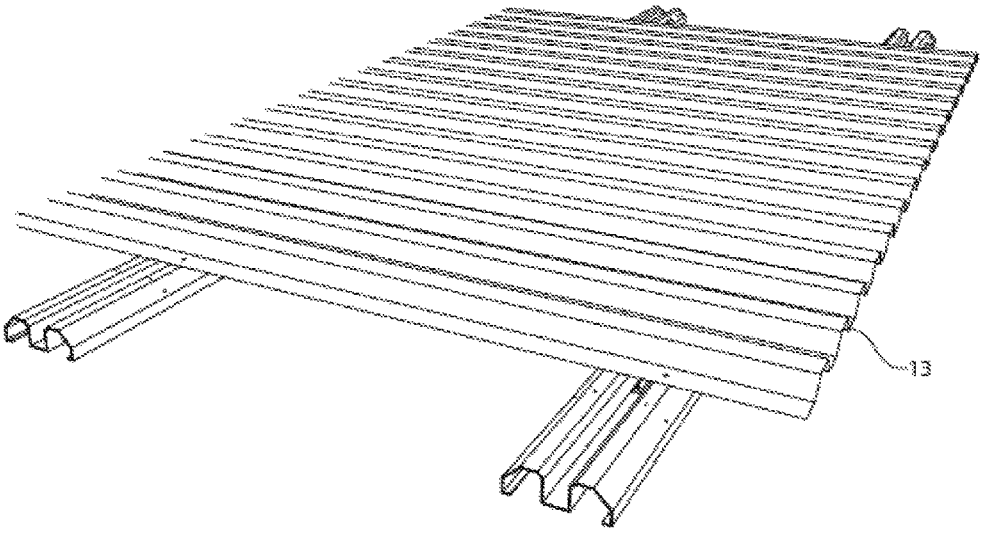

As shown in FIGS. 15A, 15B, 15C and 16, the structure (3) for coverage the present invention allows the use of tiles (13) with or without supports (14) in the structure (3) for coverage of the present invention, being evidenced, in the case of placing the support, an attaching piece (16) of the support to upper stringer (1.1), illustrated in FIGS. 15A, 15B and 15C.

The structure (3) for coverage of the present invention allows, in addition to its use in the system initially disclosed in PI 7805402-8 (FIGS. 17 and 18), the installation of several embodiments of coverage (FIGS. 15 and 16) as well as allows a simpler design, assembly and installation of the structure (3) for coverage (and the coverage thereof) due to the plasticity and standardization of materials used.

It should be emphasized that in spite of great plasticity and adaptability to projects, the structure (3) for coverage of the present invention has only four basic pieces, namely: stringer (1), connecting plates (6), diagonals (11) and supports (14).

The above explanation, in spite of being broad, does not exclude other embodiments which eventually may arise from the present invention, both by a different constructive model and by new characteristics, contemplated due to practical development of present invention, not being, therefore, the present invention limited to the topics described above.

What is claimed is:

1. Structure for coverage, comprising:

at least one upper (1.1) and lower (1.2) stringer (1);

a plurality of cross-members (12);

a plurality of diagonals (11); and a plurality of connecting plates (6*a*, 6*b*), wherein a union of stringers (1) and diagonals (11) form beams (2), and a union of stringers (1), cross-members (12) and diagonals (11) form structures (3), each stringer (1) comprising:

a 'W' shaped body symmetrical about a central vertical axis comprising two 'U' shaped bodies connected by a connection segment (113), wherein each "U" shaped body comprises a pair of spaced apart parallel segments (102, 106, 107, 111), a bottom segment (104, 109) perpendicular to the parallel segments (102, 106, 107, 111), a first angled segment (103, 110) extending between a one of the pair of parallel segments (102, 111) and the bottom segment (104, 109), a second angled segment (105, 108) extending between an other of the pair of parallel segments (106,107) and the bottom segment (104, 109), and a lateral segment (101, 112) extending inwardly into the "U" from a one of the pair of parallel segments (102, 111);

a plurality of holes (5, 7, R) and a plurality of pairs of opposing fins (9),wherein the fins (9) extend perpendicularly from the connection segment (113), wherein at least one of the plurality of holes (5, 7, R) is arranged in each of the first angled segment (103, 110), the second angled segment (105, 108), the bottom segment (104, 109), and the connection segment (113), wherein:

in the connection segment (113) are arranged pairs of said opposing fins (9) and at least six connection segment holes (5*a*, 5*b*, 5*c*, 5*d*, 5*e* and 5*f*) arranged longitudinally along the connection segment, wherein at least three of the connection segment holes (5*a*, 5*b*, 5*c*, 5*d*, 5*e* and 5*f*) are located in the connection segment (113) adjacent each side of a pair of fins (9), in the bottom segment (104 and 109) are arranged four bottom segment holes (7*a*, 7*b*, 7*c* and 7*d*), in the second angled segment (105 and 108) are arranged second angled segment holes in rectangular shape (R), a first pair of said bottom segment holes (7*a* and 7*b*) being separated by a second angled segment hole (R) from a second pair of said bottom segment holes (7*c* and 7*d*); and in the first angled segment (103 and 110), are arranged twelve first angled segment holes (7*e*, 7*f*, 7*g* 7*h*,5*g*, 5*h*, 5*i*, 5*j*, 5*l*, 5*m*, 5*n* and 5*o*);

wherein, four of the connection segment holes (5*a*, 5*b*, 5*e* and 5*f*) and eight of the first angled segment holes (5*g*, 5*h*, 5*i*, 5*j*, 5*l*, 5*m*, 5*n* and 5*o*) are used to attach at least a portion of the connecting plates (6*a*, 6*b*) to the at least one stringer (1), wherein connecting plate holes (10*a*, 10*b*, 10*c*, 10*d*, 10*e*, 10*f*, 10*g*, 10*h*) are arranged in order to promote connection by a fastener between the at least one stringer (1) and connecting plates (6*a*, 6*b*), wherein, the connecting plates (6*a*, 6*b*) are configured to be arranged on the at least one stringer (1) for connecting an end of said at least one stringer (1) to an end of a second stringer (1), wherein said connecting plates (6*a*, 6*b*) comprise:

a 'U' shape body with pair of spaced apart parallel connecting plate side segments (601, 603) and a connecting plate bottom segment (602) extending between the connecting plate side segments (601, 603); and the plurality of connecting plate holes (10*a*, 10*b*, 10*c*, 10*d*, 10*e*, 10*f*, 10*g*, 10*h*) in the connecting plate bottom segment (602), said connecting plate holes (10*a*, 10*b*, 10*c*, 10*d*, 10*e*, 10*f*, 10*g*, 10*h*) being arranged in a longitudinal direction, wherein a spacing of said connecting plate holes (10*a*, 10*b*, 10*c*, 10*d*, 10*e*, 10*f*, 10*g*, 10*h*) is a function of a spacing of the four of the connection segment holes (5*a*, 5*b*, 5*e* and 5*f*) and a spacing of the eight of the first angled segment holes (5*g*, 5*h*, 5*i*, 5*j*, 5*l*, 5*m*, 5*n* and 5*o*) in the at least one stringer (1).

2. The structure for coverage according to claim 1, further comprising beams (2) having different heights with different lengths of diagonals (11) and structures (3) having different widths with different lengths of cross-members (12).

3. The structure for coverage according to claim 1, further comprising counter-diagonals (4) extending between adjacent diagonals (11).

4. The structure for coverage according to claim 1, wherein in a first connecting plate (6*a*) central connecting plate holes (10*d* and 10*e*) are separated by a first distance, wherein in a second connecting plate (6*b*) central connecting plate holes (10*d* and 10*e*) are separated by a second distance, wherein the first distance is greater than the second distance.

5. The structure for coverage according to claim 1, further comprising tiles (13) attached to at least one upper stringer (1.1).

6. The structure for coverage according to claim 5, further comprising supports (14), comprising a clamping piece (16) attached to the upper string (1.1).

7. The structure for coverage according to claim 1, further comprising tiles in a coil configuration (15) attached to at least one upper stringer (1.1).

* * * * *